US005605292A

United States Patent [19]

Bunton

[11] Patent Number: 5,605,292

[45] Date of Patent: Feb. 25, 1997

[54] PULVERIZER MILL HIGH PERFORMANCE CLASSIFIER SYSTEM

[75] Inventor: Joe H. Bunton, Ft. Collins, Colo.

[73] Assignee: March-Southwestern Corp., Ft. Collins, Colo.

[21] Appl. No.: 524,246

[22] Filed: Sep. 6, 1995

[51] Int. Cl.[6] ..... B02C 15/04

[52] U.S. Cl. ..... 241/79.1; 241/121

[58] Field of Search ..... 241/117, 119, 241/127, 79.1; 209/140, 141

[56] References Cited

U.S. PATENT DOCUMENTS

| | | | |
|---|---|---|---|
| 4,597,537 | 7/1986 | Misaka et al. | 241/119 X |
| 4,605,174 | 8/1986 | Maliszewski | 241/119 X |
| 4,689,141 | 8/1987 | Folsberg | 241/119 X |

FOREIGN PATENT DOCUMENTS

| | | | |
|---|---|---|---|
| 503547 | 7/1930 | Germany | 241/119 |
| 55088 | 3/1994 | Japan | 241/119 |

*Primary Examiner*—Mark Rosenbaum
*Attorney, Agent, or Firm*—Dean P. Edmundson

[57] ABSTRACT

A high performance classifier system for use in a pulverizer mill (e.g., a mill used to crush large coal particles into small particles). The classifier system includes a cylindrical extension member with a roughened interior surface. Other permitted features include a converging/diverging orifice on the interior surface of the mill body, curved classifier vanes at the upper end of the classifier, and tilted vanes between the mill housing and the upper end of the classifier. Improvements in efficiency of particle separation are achieved.

16 Claims, 4 Drawing Sheets

PULVERIZER MILL HIGH PERFORMANCE CLASSIFIER SYSTEM

FIELD OF THE INVENTION

This invention relates to pulverizer mills, e.g., mills that are used for the crushing of large pieces of coal into smaller coal particles. More particularly, this invention relates to a dust separating system known as a classifier which is designed to segregate large, partly ground coal particles from smaller, completely ground particles within a pulverizer mill.

BACKGROUND OF THE INVENTION

Pulverizer mills are commonly used for crushing large coal pieces into small particles which are required for conventional coal fired boilers. A common type of pulverizer includes a flat or dished grinding table which is attached to and driven by a vertical spindle and three (3) large rollers or wheels which rotate around separate shafts as the table (or bowl) rotates with the vertical spindle. Large coal particles are introduced onto the table (or bowl) and are crushed as they are captured between the rollers and the table. An air stream (known as Primary Air Flow) passing upwardly around the bowl carries the crushed coal particles upward into the classifier through the classifier vanes and then out of the mill to the boiler through an outlet pipe (or pipes).

Occasionally large coal particles are swept up and out through the outlet pipe due to the high velocities of the Primary Air Flow inside the top of the classifier. This is an undesirable characteristic of all coal pulverizers. In order to minimize the amount of large coal particles which are swept out of the mill, a cone-shaped classifier has been used in all prior art designs for receiving partly crushed coal particles and for separating large particles which must be crushed further from the fine particles (which are desired). The interior surfaces of all prior art classifiers are smooth. Although the classifier is an integral part of all vertical spindle mill designs, it is not as effective as desired in many instances. Consequently, the grinding capacity of a mill can be limited because of the inherent inefficiencies of present classifier designs. Or conversely, the large amounts of unburned coal found in the ash of many typical boilers reduces the efficiency of said boiler and increases the operating costs of the user.

There has not heretofore been described a classifier system having the advantages provided by the present invention.

SUMMARY OF THE PRESENT INVENTION

In accordance with the present invention there is provided an improved classifier system for a pulverizer mill (e.g., a mill of the type used for crushing coal into fine particles). The improved classifier system includes a cylindrical extension member (sometimes referred to herein as a Finned Cyclone Classifier Section) which is secured to and extends vertically upwardly from the upper end of the conical classifier. The Finned Cyclone Classifier Section (cylindrical extension member) includes an interior surface which includes a plurality of projections extending radially inward.

In preferred embodiments the improved classifier system also includes an intermediate classification liner attached circumferentially to the interior surface of the mill housing high above the grinding elements (or grinding zone). The intermediate classification liner provides a converging-diverging orifice assembly which extends around the interior surface of the housing between the grinding zone and the classifier. This intermediate classification liner redirects the upwardly moving and turbulent Primary Air Flow towards the center of the pulverizer. This redirection of the Primary Air Flow will result in a large loss of upward momentum in the bigger partly ground coal particles, allowing them to fall back into the grinding zone without passing through the classifier. This new method of particle separation is referred to herein as Intermediate Classification.

In another embodiment the classifier system includes curved classifier vanes at the upper end (and inlet) of the classifier, and preferably (but not necessarily) the vanes extend downwardly to a point below the air inlet to the classifier. The curved vanes greatly enhance the spin of the air flow entering the upper end of the classifier, although larger flat vanes may also be used.

Another improvement involves a plurality of vanes located on the interior surface of the pulverizer housing and located immediately below the inlet to the upper end of the classifier or immediately below the lower end of the classifier vanes. This plurality of vanes, being a new design feature not found in any prior art description, is referred to herein as a Spin Initiator. The plurality of vanes are located parallel to each other and are tilted at an angle in the range of about 30° to 45° relative to the vertical plane. The Spin Initiator effectively controls the upwardly flowing and turbulent Primary Air Flow within the upper region of the mill housing. The Spin Initiator re-directs the air flow, causing a strong clockwise or counter-clockwise motion of the Primary Air Flow, depending upon the specific mill design. This turning of the Primary Air Flow greatly increases the efficiency of the classifier vanes.

Another embodiment of this High Performance Classifier System is referred to as the Outlet Turret Extension. This cylindrical shaped spacer assembly is located at or near the top of the existing pulverizer mill body. This extension is positioned in such a manner so as to increase the overall height of the existing coal pulverizer mill. By increasing the overall height of said pulverizer mill, the volume is thusly increased as well. This increase in volume will improve the efficiency of coal particle separation within the body of the pulverizer mill. This Outlet Turret Extension has parallel sides and is normally Cylindrically shaped (although other shapes may exist if the existing pulverizer mill housing so dictates), the length of which is determined for each individual coal pulverizer mill.

By carefully controlling the primary air flow in the upper part of the mill housing, enhanced particle separation can be realized. This new method of particle separation is termed intermediate classification, and large coal particles lose their upward momentum due to the re-directed air flows and fall back down into the grinding zone. Also, the air flow is effectively turned prior to entering the classifier vane section of the pulverizer. This greatly enhances the performance of the classifier vanes and, thus, the entire classifier section.

The coal particles, which are carried out of the mill by the Primary Air Flow, are much more finely ground (the fineness is greatly improved) when compared to other prior art classifier designs. This system is as easy to retrofit as any conventional replacement static classifier and much less expensive than dynamic or rotating classifiers which are currently available. Also no additional power requirements are needed for auxiliary drive motors or other associated equipment which may be necessary with rotating classifiers. This system of the invention greatly reduces the amount of unburned (wasted) coal which ultimately must be purchased by the user of the pulverizer mill.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
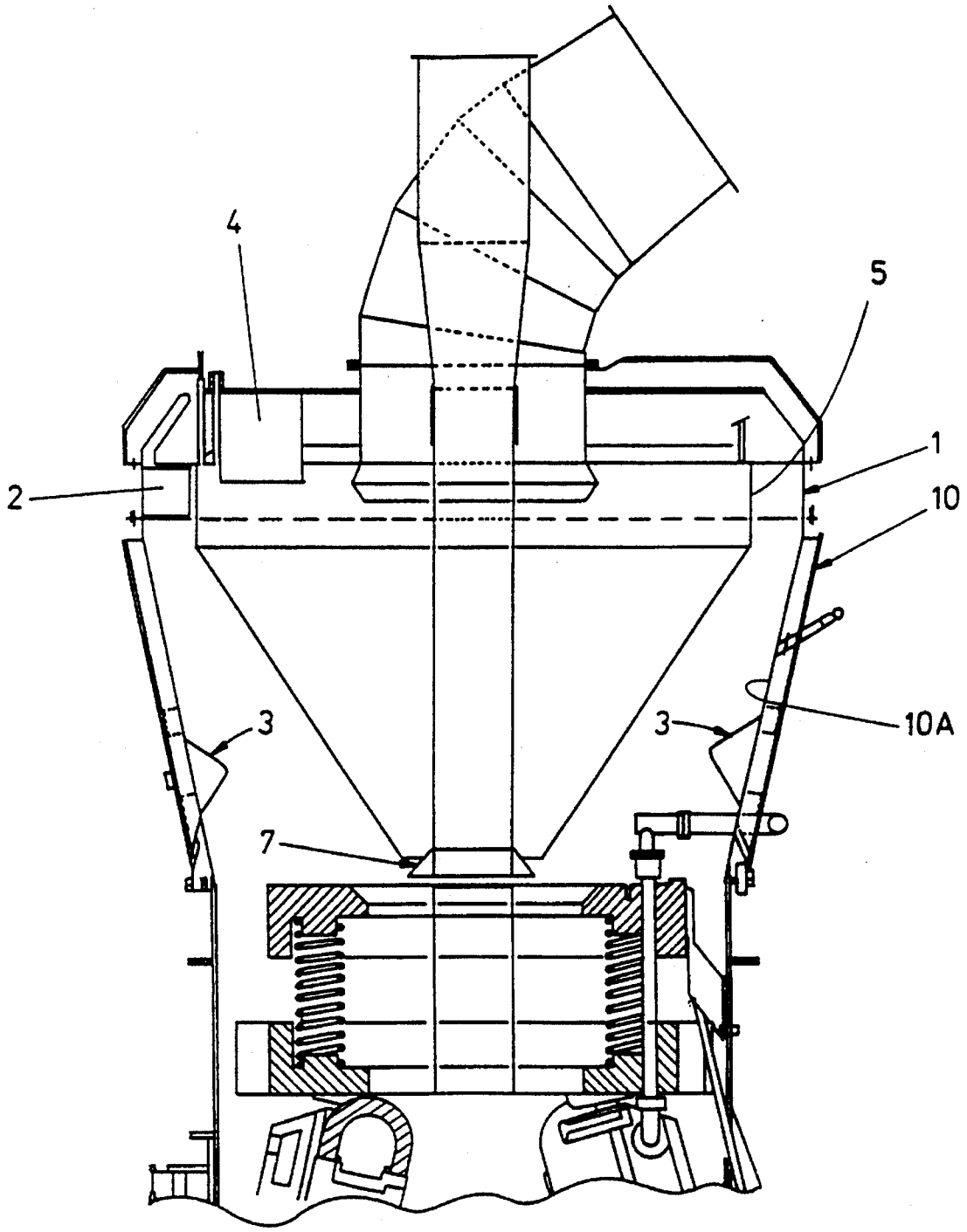
FIG. 1 is a side elevational, cut-away view of the pulverizer mill which includes one embodiment of the improved High Performance Classifier System of the invention.
Figure 3:
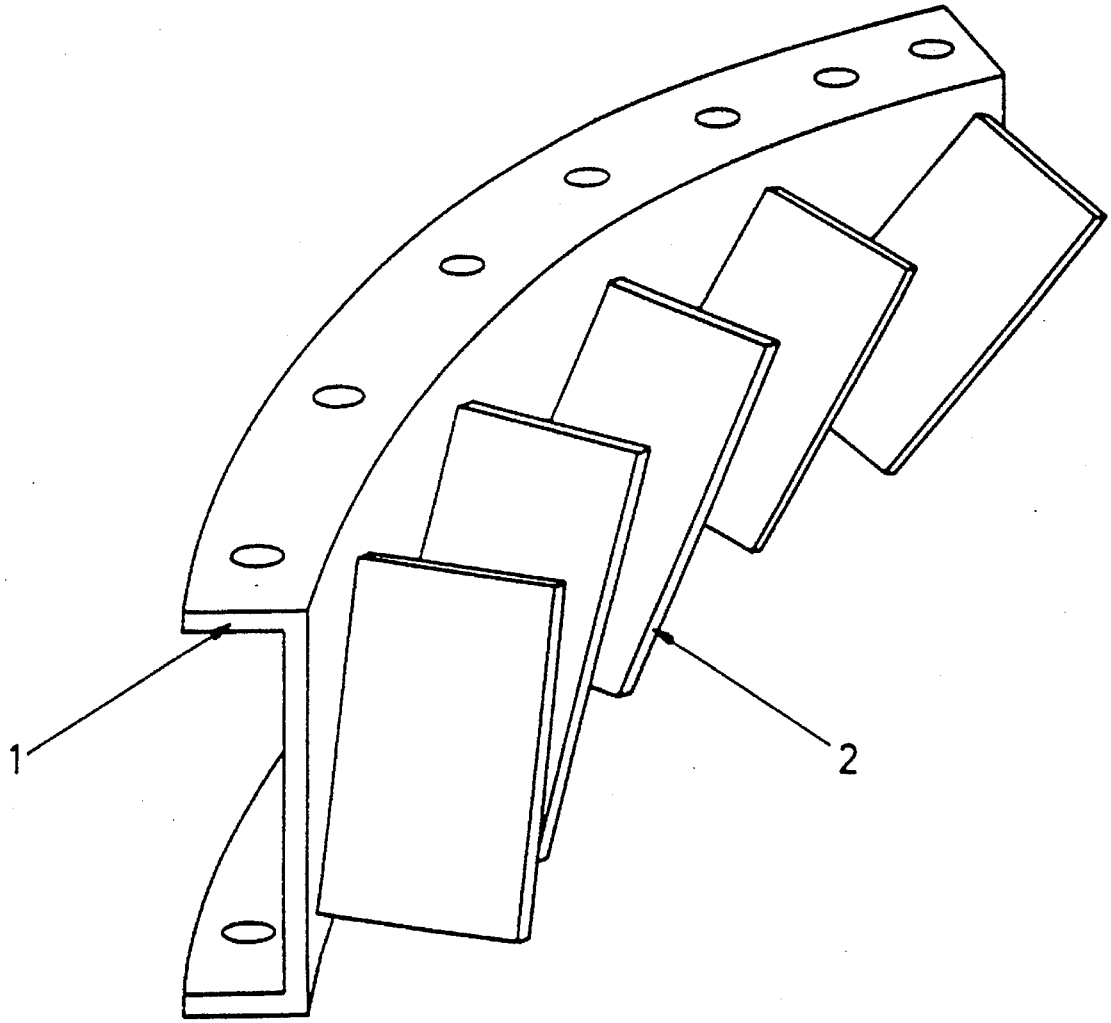
FIG. 3 is a perspective view of a segment of one embodiment of the spin initiator which in this view is integral with the Outlet Turret Extension which is useful in the invention.

In reference to FIG. 1, the High Performance Classification System, all components of the said classification system are constructed of a steel material, either mild steel or of a wear-resistant type. Further, said components may be protectively lined or covered with abrasion-resistant ceramic tiles of numerous descriptions. Also said components may be protectively lined or covered with welded overlays of high-alloy wear-resistant material. In FIG. 1, the Outlet Turret Extension 1 is located at the top of the existing pulverizer mill body 10. This Outlet Turret Extension acts as a volume-increasing device which may be located either at the top of or the bottom of any existing coal pulverizer mill housing (or body). The specific design of the coal pulverizer mill will dictate the location and installation method of the Outlet Turret Extension. Typical installation methods include a bolted and flanged arrangement or simply a weld-in modular design. The Outlet Turret Extension will be constructed with a cross-sectional shape which is identical to the existing pulverizer mill body. This shape may be cylindrical, hexagonal, or any other shape utilized by coal pulverizer manufacturers. Note that the Outlet Turret Extension is also shown in FIG. 3.

Also in FIG. 1 is the Spin Initiator 2. The Spin Initiator comprises a plurality of evenly-spaced vanes, which are oriented at 30° to 45° off of a vertical axis. The Spin Initiator Vanes are normally welded to the interior surface of the coal pulverizer mill body. However in certain installations, as is shown in FIG. 3, the Spin Initiators may be combined with and secured to the Outlet Turret Extension. This will minimize the installation difficulties and costs for the end user of the coal pulverizer mill. Although both drawings depict the Spin Initiator and the Outlet Turret Extension as an integral unit these devices may, in fact, be installed as separate units in the High Performance Classification System.

FIG. 1 also depicts the Intermediate Deflector Liner 3. The Intermediate Deflector Liner is a circumferentially-built converging-diverging orifice assembly. Also constructed of a steel material as described above, this liner assembly may be bolted or welded to the interior surface 10A of the existing pulverizer mill body. As dictated by the individual pulverizer mill design, the Intermediate Deflector Liner will be constructed with upwardly and downwardly sloping surfaces which are oriented at 30° to 60° off of a horizontal axis. Thus, the total developed angle between the two sloping surfaces would be in the range of 60° to 120°. The components of the Intermediate Deflector Liner may be designed and built as a single unit or may be designed as separate smaller segments for easier installation.

Figure 4A:
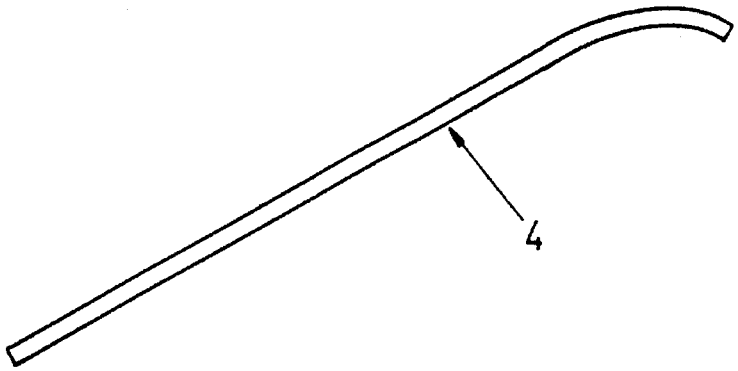
FIG. 4*a* is a top view of the classifier vane shown in FIG. 4.
Figure 4:
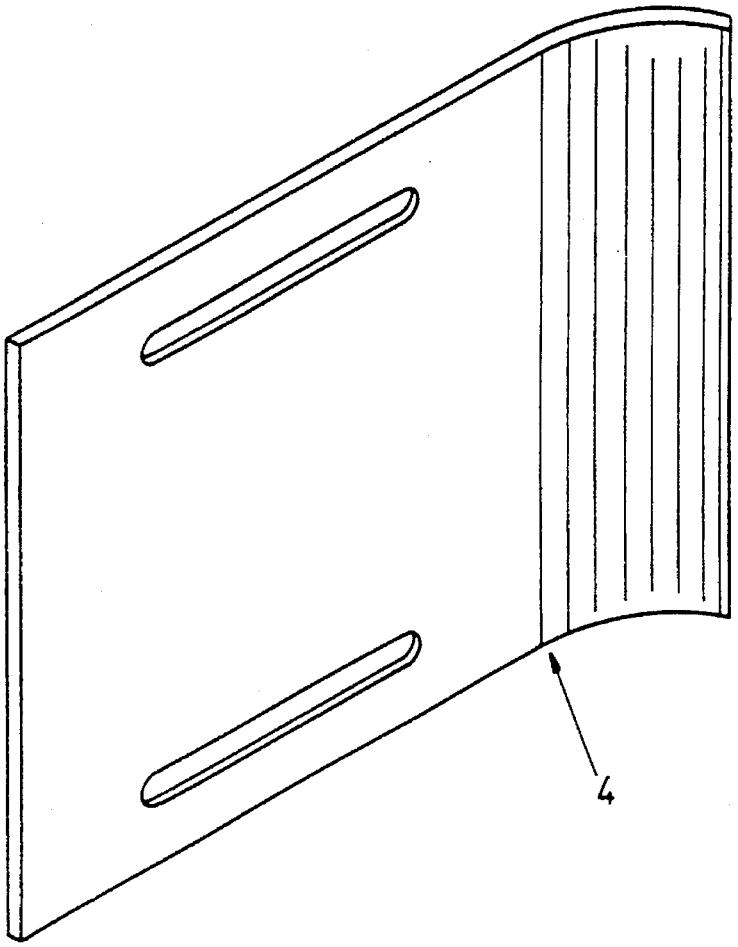
FIG. 4 is a perspective view of a preferred embodiment of the cesta curved classifier vane which is useful in this invention.

Another feature of the High Performance Classification System shown in FIG. 1 are the Cesta-Curved Classifier Vanes 4. The cesta-curved feature is one of the preferred embodiments of this design and will increase the efficiency of the coal particle separation in the top region of the interior of the classifier cone. However, flat or planar classifier vanes may be utilized with only a slight degradation of the High Performance Classification System's performance. The flat classifier vanes will reduce costs and are easier to construct from a wear-resistant material. The cesta curve of the classifier vanes is unique to this High Performance Classification System. Note that this classifier vane design is also shown in FIG. 4.

Figure 2:
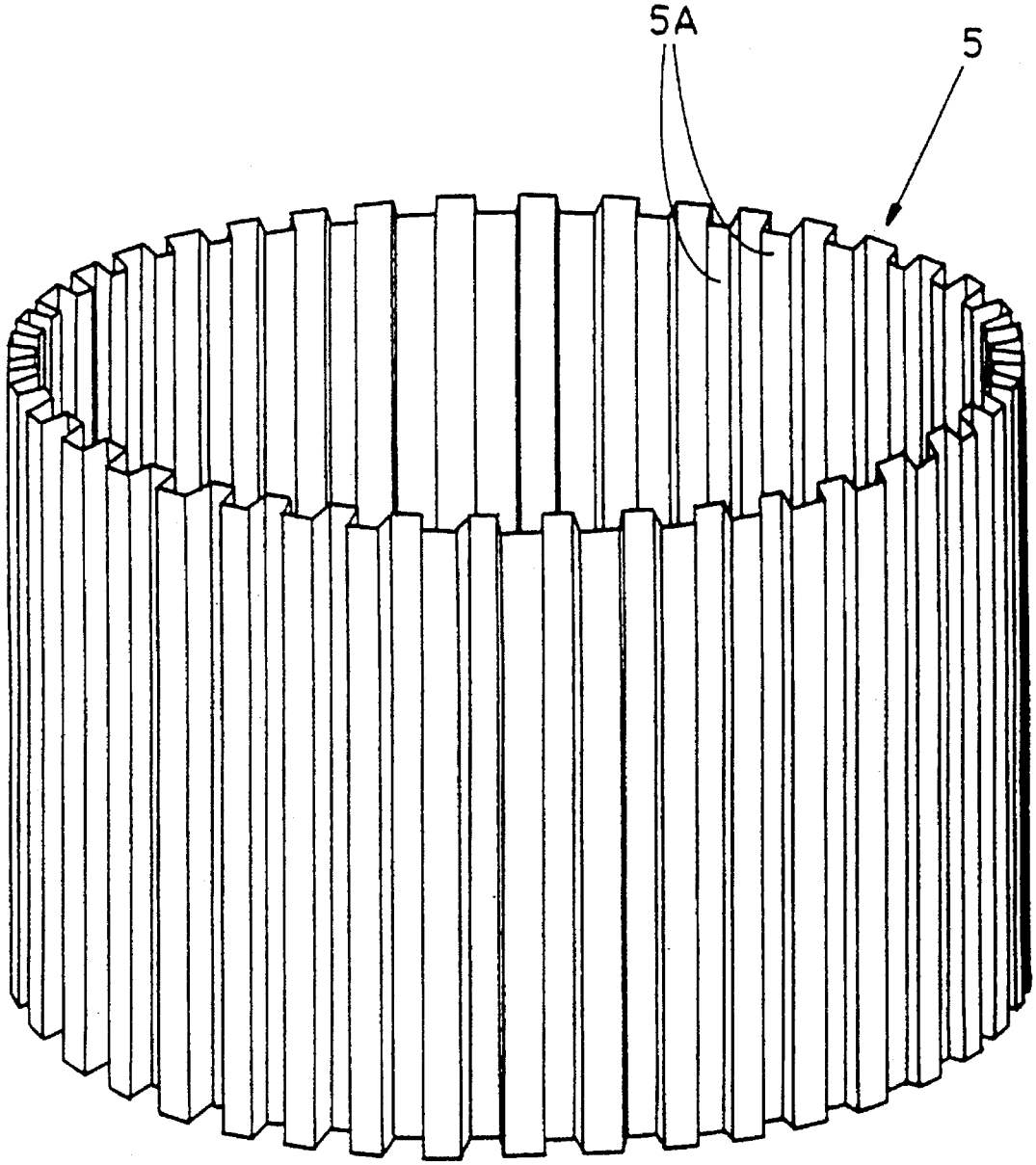
FIG. 2 is a perspective view of one embodiment of the cylindrical extension member known as the Finned Cycloned Classifier Section which is useful in the invention.

The Finned Cyclone Classifier Section 5 is also shown in FIG. 1. A detailed view of one embodiment of this cylindrical extension member is shown in FIG. 2. The interior surface of this section of the classifier is rough by design. It may be thought of as being similar to the corrugations found in certain types of cardboard construction. This roughened surface area, which consists of a plurality of spaced and radially inward projecting structures 5A, may have a variety of different designs. The details shown in FIG. 2 represent a piece of steel sheet which has been folded and bent into the shape drawn. Other construction methods may include the welding or fastening steel bars, which in themselves may be a variety of shapes, to the inside surface of the Cylindrical Extension Member. The essence of this design feature is that the projections and the increased surface area provided by this roughened interior surface will much more rapidly slow the movement of any large coal particles which may come into contact with it. The roughened interior surface may be in the nature of vertical bars, slanted bars, discontinuous bumps or bars, or combinations of any of these, to disturb the surface flow of the circulating air and coal particle flow. In another embodiment the High Performance Classifier System may include a Classifier Cone Outlet Extension, as is known in the art. This outlet extension is useful in the control of partly ground coal particles, in that these partly ground particles may be more accurately returned to the grinding zone of the pulverizer. This outlet extension may be a parallel-sided, cylindrical shape normally constructed from a mild or wear-resistant steel material. This outlet extension will, in many cases, enhance the control of the coal fineness by increasing the efficiency of the crushing of the already partly-ground coal particles.

The cone outlet may also include an adjustable restriction ring 7 which may be used to control the Primary Air Flow in such a way that this air will not flow into the lower end of the cone or upwardly through the interior of the High Performance Classifier, thus reducing the efficiency of the system. The ring 7 defines an annular opening at the lower end of the cone.

Other variants are possible without departing form the scope of this invention.

What is claimed is:

1. In a pulverizer mill of the vertical spindle type including a grinding means for crushing coal, a vertical feed pipe for introducing coal to said grinding means, a cone-shaped classifier for separating large particles from small particles, and air flow means passing upwardly from said pulverizer means to said classifier, wherein said classifier includes upper and lower ends, and wherein the improvement comprises a cylindrical extension member secured to and extending vertically upward from said upper end of said classifier, wherein said extension member includes an interior surface, and wherein said interior surface includes a plurality of projections extending radially inward.

2. A pulverizer mill in accordance with claim 1, wherein said mill includes a housing having an interior surface, and further comprises an intermediate classification liner attached to said interior surface of said housing, wherein said classification liner provides a converging-diverging orifice; wherein said intermediate classification liner extends around the interior surface of said housing above said grinding means, below said upper end of said classifier, and above said lower end of said classifier; and wherein said classification liner extends inwardly from said interior surface of said housing a distance in the range of about 4 to 12 inches.

3. A pulverizer mill in accordance with claim 1, wherein said classifier includes an inlet; and further comprising curved classifier vanes at said upper end of said classifier, wherein said vanes include a cesta curve.

4. A pulverizer mill in accordance with claim 3, wherein said classifier vanes extend downwardly to a point below said inlet.

5. A pulverizer mill in accordance with claim 1, wherein said mill includes a housing, and further comprising a plurality of vanes disposed between said housing and said upper end of said classifier.

6. A pulverizer mill in accordance with claim 5, wherein said vanes are parallel to each other and are oriented at an angle in the range of about 30° to 45° relative to a vertical plane.

7. In a pulverizer mill in accordance with claim 1, wherein said mill includes a housing, and further comprises a volume-increasing spacer assembly located at the top of said housing.

8. In a pulverizer mill of the type including a housing having an interior surface, pulverizer means for crushing coal, a vertical feed pipe for feeding coal to said pulverizer means, a cone-shaped classifier for separating large particles from small particles, and air flow means passing upwardly from said pulverizer means to said classifier, wherein said classifier includes upper and lower ends, and wherein the improvement comprises:

(a) a cylindrical extension member secured to and extending vertically upward from said upper end of said classifier, wherein said extension member includes an interior surface, and wherein said interior surface includes a plurality of projections extending radially inwardly; and (b) an intermediate classification liner attached to said interior surface of said housing, wherein said classification liner provides a converging-diverging orifice.

9. A pulverizer mill in accordance with claim 8, wherein said orifice includes a downwardly-sloping surface and an upwardly sloping surface; wherein each said surface has a width in the range of about 4 to 12 inches.

10. A pulverizer mill in accordance with claim 9, wherein the angle of said sloping surfaces is in the range of about 30° to 60°, with the developed angle between the two sloping surfaces in the range of between 60° to 120°.

11. A pulverizer mill in accordance with claim 8, wherein said projections comprise parallel ribs.

12. A pulverizer mill in accordance with claim 8, wherein said intermediate classification liner extends around the interior surface of said housing above said pulverizing means.

13. A pulverizer mill in accordance with claim 8, further comprising curved classifier vanes at said upper end of said classifier, wherein said vanes include a cesta curve.

14. A pulverizer mill in accordance with claim 8, wherein said classifier includes an inlet, and wherein said classifier vanes extend downwardly to a point below said inlet.

15. A pulverizer in accordance with claim 8, further comprising a plurality of vanes disposed between said housing and said upper end of said classifier.

16. A pulverizer mill in accordance with claim 15, wherein said vanes are parallel to each other and are oriented at an angle in the range of about 30° to 45° relative to a vertical plane.

* * * * *